United States Patent [19]

Acosta, Sr. et al.

[11] Patent Number: 4,908,957

[45] Date of Patent: Mar. 20, 1990

[54] SHOE DRYER

[76] Inventors: Corby A. Acosta, Sr., P.O. Box 1137, Buras, La. 70041; Clarence A. Gartoucies, P.O. Box 111, Venice, La. 70091; Matthew Sumich, P.O. Box 1012, Buras, La. 70041

[21] Appl. No.: 334,527

[22] Filed: Apr. 7, 1989

[51] Int. Cl.[4] ..... F26B 13/30

[52] U.S. Cl. ..... 34/86; 34/90

[58] Field of Search ..... 34/90, 86, 91, 82, 192, 34/195

*Primary Examiner*—Henry A. Bennet

*Attorney, Agent, or Firm*—Richard C. Litman

[57] ABSTRACT

An apparatus for the drying of shoes and other items utilizing the exhaust heat from a clothes drying machine. The apparatus is connected to the exhaust of a clothes drying machine. The hot air of the exhaust is vented through the body of the shoe dryer to dry items placed therein. Vents are positioned at the top of the shoe dryer to provide control of the temperature of the drying process. The shoe dryer can be mounted atop the clothes drying machine or it maybe wall mounted. The exhaust from the shoe dryer can be vented to the environment as is customary or it may be used to supplement the heating of a home.

10 Claims, 2 Drawing Sheets

SHOE DRYER

BACKGROUND OF THE INVENTION

1. Field of the Invention

The present invention relates to those devices that are designed specifically to dry shoes. More specifically, the present invention relates to shoe dryers that can be attached to a drying machine. The present invention utilizes the exhaust heat of the drying machine to which it is attached.

The primary problem associated with drying shoes in an automatic clothes dryer is that the shoes must be dried separately from clothes. Not only is this a waste of time, but it is also a waste of energy. The present invention provides an equitable solution to this problem.

2. Description of the Prior Art

A number of dryers for shoes have been developed in the past. Most of them involve features that are specifically directed at the drying of the interior of a shoe or boot. A typical shoe dryer is best exemplified by U.S. Pat. No. 4,758,293 issued to Michael G. Kaffka on September 6, 1988. The Kaffka patent describes a device that can be placed within a ski boot to direct warm air toward the toe of the boot.

Though this application may be particularly applicable in certain circumstances, it is rare that a shoe will get wet at the toe only. For the most part, when shoes get wet, it is the entire shoe that is effected. As a result, it becomes necessary to dry the entire shoe in a quick and convenient manner.

Often, persons who have soaked their shoes will throw them into the drying machine. This is especially true for tennis shoes or sneakers. The problem with this particular method is that shoes cannot often be dried along with clothing. Thus, every cycle used to dry the shoes wastes valuable dryer time. Moreover, the energy waste is not insubstantial.

U.S. Pat. No. 3,197,886 issued to G. R. Brame et. al. on August 3, 1965 offers a partial solution to this problem. Brame describes a dryer attachment that can be used to dry fabrics outside of a drying machine. the device utilizes the exhaust heat from a standard dryer.

Still better than Brame is U.S. Pat. No. 3,256,616 issued to J. M. McGoldrick on June 21, 1968. McGoldrick discloses a dryer attachment specifically adapted to the drying of shoes. The dryer attachment utilizes the exhaust heat to dry shoes in a compartment separate and downstream of the drying machine. McGoldrick adds a nozzle arrangement to dry the toes of the shoes as well as the exterior.

As useful as McGoldrick appears, its function is limited solely to the drying of shoes. The present invention goes a step further than both Brame and McGoldrick. The present invention provides an attachment to a drying machine that can both dry shoes and delicate fabrics. Additionally, the present invention provided a means to deodorize or to add a pleasant scent to the items placed therein.

SUMMARY OF THE INVENTION

Thus, it is an object of the present invention to provide an attachment to a drying machine that can be used to dry both shoes and delicate fabrics.

It is yet another object of the present invention to provide a means for the drying of shoes and delicate fabrics that utilizes the excess heat from a clothes drying machine.

It is still another object of the present invention to provide a means of filtering out particulate material from the drying chamber after the hot air has passed over the items placed therein.

It is an additional object of the present invention to provide a means to deodorize any items during drying which have been placed within the present invention.

It is another object of the present invention to provide a means to add a perfume or pleasant smell to the items placed within the main chamber of the drying apparatus.

It is still another object of the present invention to provide a means to divert the exhaust heat from a dryer into home during the winter months to conserve the use of electricity within the home.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

Similar reference characters designate corresponding parts throughout the various figures of the drawings.

DESCRIPTION OF THE PREFERRED EMBODIMENT

Figure 1:
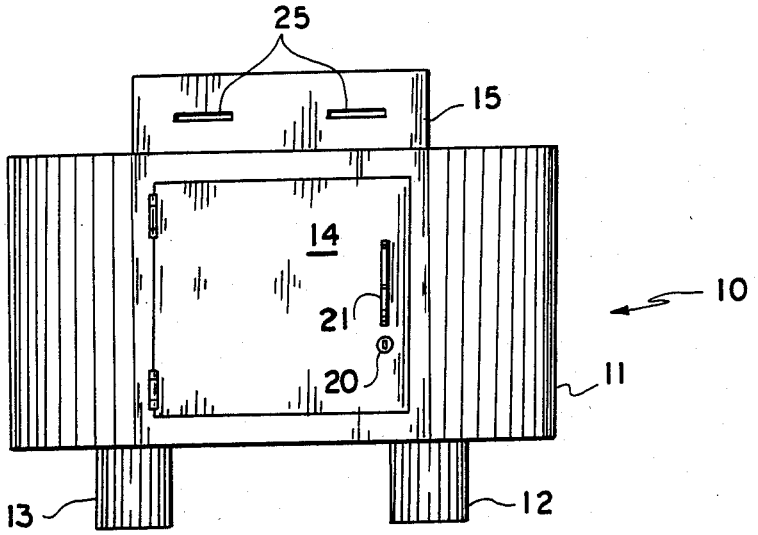
FIG. 1 is a side elevation illustration of the present invention showing the pertinent external features.
Figure 2:
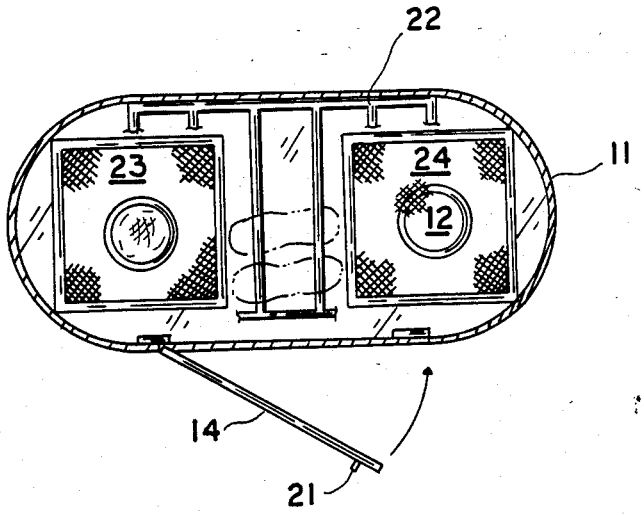
FIG. 2 is a top elevation cross-sectional illustration of the present invention as described in FIG. 1. The internals of the present invention are pictorially described.
Figure 3:
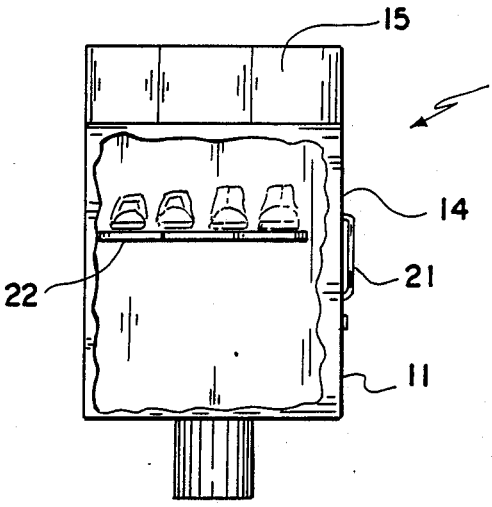
FIG. 3 is an end cutaway illustration of the present invention showing the envisioned placement of shoes.

The apparatus of the present invention is generally designated by 10 in FIG. 1. The shoe dryer 10 is comprised of essentially three major components, the closet 11, the inlet duct 12, and the outlet duct 13. Peripheral features include the door 14 and the vented housing 15.

Figure 4:
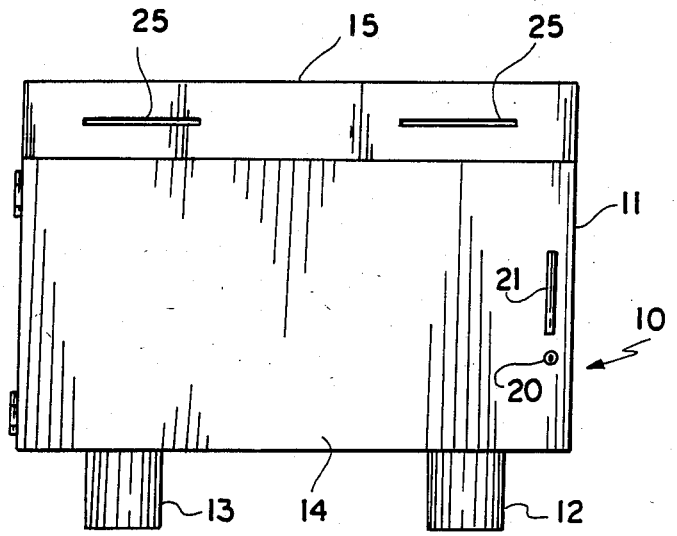
FIG. 4 is a side elevation illustration of the present invention in a different embodiment, namely the closet is rectilinear rather than oval in cross-section.

The closet 11 forms the main body of the shoe dryer 10. The closet 11 is essentially a hollow body having four sides, a top side, and a bottom side. The present invention is envisioned to take two primary shapes. Referring to FIG. 1, the closet 11 has an oval horizontal cross-section. FIG. 4 shows the closet 11 in a second embodiment, namely having a rectangular cross-section. It is noted, however, that these do not constitute the total possibility of closet 11 configurations as an infinite number of possibilities exist.

At the bottom side of the closet 11, there exist two perforations which contain the inlet duct 12 and the outlet duct 13. The inlet duct 12 and the outlet duct 13 extend from the bottom of the closet 11 in the vertical direction. Of course, any arrangement of the inlet duct 12 and the outlet duct 13 that serves the purpose is acceptable.

The inlet duct 12 is connected to the outlet manifold of the clothes dryer (not shown). The hot air passes through the inlet duct 12 into the interior region defined by the closet 11. The air passes out of the closet 11 through the outlet duct 13. Structurally, the inlet duct 12 and the outlet duct 13 are the same. Both serve to help support the shoe dryer 10 should it be mounted on top of the clothes dryer machine.

The closet 11 interior may be accessed through the door 14 provided on one of the four sides. The door 14 may be locked shut when the shoe dryer 10 is in operation by the lock 20. Lock 20 may be any type of locking means that prevents the closet 11 from opening during operation. It is not necessary the door 14 be locked in the conventional sense of the word. In other words, the lock 20 does not function to prevent another person from opening the closet 11, it functions to prevent the air pressure within the closet 11 from opening the door, as with other conventional dryers, thereby reducing the closet 11 to null functionality. The door 14 may also be provided with some sort of handle 21 to make opening of the closet 11 easier.

Figure 5:
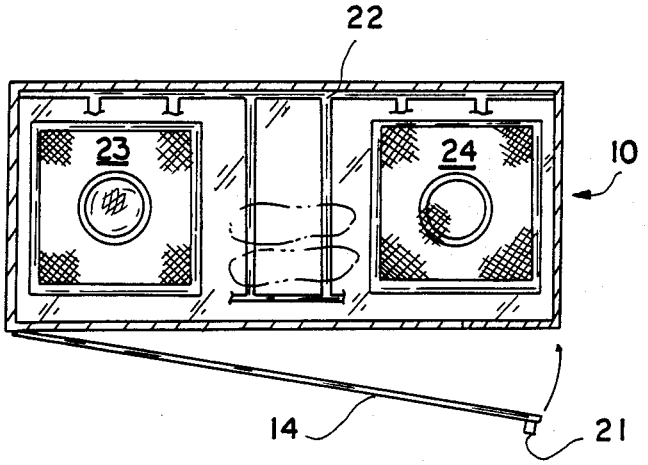
FIG. 5 is a top cross-sectional illustration like FIG. 2. However, this illustration is a top elevation of FIG. 4.

In the configuration of FIG. 1, the door 14 does not extend the full width of the side on which it is placed. This is logical as the ends of the closet 11 are rounded. In FIG. 4 and 5, however, the door 14 does extend the full height and width of the side on which it is placed. Thus, the door 14 functions in FIG. 4 and 5 both as an access to the interior of the closet 11 as well as a side of the closet 11.

The interior of the closet 11 contains a shelf 22 extending from the walls of the closet 11. The shelf 22 serves to hold whatever items may be placed into the closet 11 for drying. The shelf 22 may be placed at any height above the floor of the cabinet 22 so long as the shelf 22 allows air to flow underneath the item placed thereon. Grooves or hooks may be provided at the interior sides of the cabinet to support the shelf 22 properly. The shelf 22 allows even drying of the items placed within the closet 11, because of its configuration within the drying chamber.

Covering the hole at the bottom of the closet 11 leading into the outlet duct 13 is a mesh screen 23. The mesh screen 23 serves to filter out any particulate material such as lint from the air before it is exhausted either into the home or into the environment. This is particularly important if the exhaust heat is being used to supplement the heating if a home. One would not want to create an excessive dust problem.

Covering the hole at the bottom of the closet 11 leading into the inlet duct 12 may be placed a deodorizing packet 24. The deodorizing packet 24 is simply a type of cloth or other material impregnated with a perfuming agent. When the hot air passes through the deodorizing packet 24, the perfume is released, and the items within the closet 11 are appropriately treated. The deodorizing packet 24 could also be treated to destroy odors from items such as shoes.

The top of the closet contains a venting housing 15. The venting housing 15 extends vertically from the plane defined by the top of the closet 11. The venting housing contains a number of vents 25 displaced therethrough. The vents 25 can be opened or closed to control the temperature of the interior of the closet 11. This may be important if one is drying a delicate fabric which should not be subjected to excessive temperatures.

The shoe dryer 10 may be used to dry an number of items that can fit into its interior. Using the vents 25, the drying conditions can be adjusted to assure minimum heat damage to the item. The shoe dryer 10 may be connected to an existing clothes dryer, or it may be manufactured as part of all future dryers.

It is to be understood that the present invention is not limited to the sole embodiment described above, but encompasses any and all embodiments within the scope of the following claims.

We claim:

1. An apparatus for drying items using the exhaust heat from a clothes drying machine comprising:

a closet, said closet having closet walls defining an interior region, said closet walls having interior and exterior surfaces, said closet having a door disposed on one of said walls allowing access to said interior region, said door having a handle allowing for easy opening of said door, said door having a locking means thereon allowing for the secure closing of said door, said interior surface having at least one shelf suspended therefrom allowing for the support of items placed thereon, said closet having a top and a bottom, said top of said closet having a venting chamber projecting therefrom, said ventilating chamber having closable vents displaced therethrough, said closable vents being openable allowing for the heating of the interior of a home utilizing the exhaust heat from said apparatus thereby reducing the overall power consumption by said home, said bottom of said closet having two cylindrical protrusions extending therethrough, an inlet duct and an outlet duct, said outlet duct having at its top most region a filter, and said inlet duct having at its top most region a deodorizer.

2. An apparatus for drying items using the exhaust heat from a clothes drying machine according to claim 1, wherein:

said filter is composed of a mesh screen having a mesh size suitable to trap any lint or particles exiting from said interior chamber without substantially restricting air flow therethrough.

3. An apparatus for drying items using the exhaust heat from a clothes drying machine according to claim 1, wherein:

said deodorizer is composed of a material that releases a perfume scent when heated allowing for the deodorizing and odorizing of said items placed within said interior region.

4. An apparatus for drying items using the exhaust heat from a clothes drying machine according to claim 1, wherein:

said door is mounted and attached to said exterior surface by at least one hinge allowing for the pivoted opening of said door.

5. An apparatus for drying items using the exhaust heat from a clothes drying machine according to claim 1, wherein:

said items being shoes or the like.

6. An apparatus for drying items using the exhaust heat from a clothes drying machine according to claim 1, wherein:

said items being fabrics or the like.

7. An apparatus for drying items using the exhaust heat from a clothes drying machine according to claim 1, wherein:

said closet being a parallelopiped.

8. An apparatus for drying items using the exhaust heat from a clothes drying machine according to claim 1, wherein:

said closet being a parallelepiped with rounded corners and edges.

9. An apparatus for drying items using the exhaust heat from a clothes drying machine according to claim 1, wherein:

said closet being mountable to a wall.

10. An apparatus for drying items using the exhaust heat from a clothes drying machine according to claim 1, wherein:

said closet being mountable upon the top surface of said clothes drying machine.

* * * * *